US007501764B2

(12) United States Patent
Ohmi et al.

(10) Patent No.: US 7,501,764 B2
(45) Date of Patent: Mar. 10, 2009

(54) FLUORESCENT LAMP AND METHOD OF MANUFACTURING SAME

(75) Inventors: Tadahiro Ohmi, Sendai (JP); Yasuyuki Shirai, Sendai (JP); Akihiro Morimoto, Sandai (JP)

(73) Assignee: Foundation for Advancement of International Science, Tsukuba (JP)

( * ) Notice: Subject to any disclaimer, the term of this patent is extended or adjusted under 35 U.S.C. 154(b) by 301 days.

(21) Appl. No.: 10/546,182

(22) PCT Filed: Feb. 18, 2004

(86) PCT No.: PCT/JP2004/001767

§ 371 (c)(1),
(2), (4) Date: Aug. 18, 2005

(87) PCT Pub. No.: WO2004/075242

PCT Pub. Date: Sep. 2, 2004

(65) Prior Publication Data

US 2006/0097641 A1 May 11, 2006

(30) Foreign Application Priority Data

Feb. 18, 2003 (JP) ..... 2003-040364

(51) Int. Cl.
*H01J 61/04* (2006.01)
*H01J 61/06* (2006.01)

(52) U.S. Cl. ..... 313/631; 313/484; 313/485; 313/486

(58) Field of Classification Search ..... 313/631, 313/318.01–318.12, 484–493, 623; 345/47
See application file for complete search history.

(56) References Cited

U.S. PATENT DOCUMENTS

| | | | | |
|---|---|---|---|---|
| 6,853,139 | B2 | 2/2005 | Yamashita et al. | |
| 6,972,521 | B2 | 12/2005 | Scholl et al. | |
| 2002/0002988 | A1 | 1/2002 | Ichibakase | |
| 2002/0047525 | A1 * | 4/2002 | Scholl et al. | 313/637 |
| 2002/0140351 | A1 * | 10/2002 | Yamashita et al. | 313/623 |

FOREIGN PATENT DOCUMENTS

| | | | |
|---|---|---|---|
| JP | 47-40436 | * | 10/1972 |
| JP | 47-40436 | B1 | 10/1972 |
| JP | 53-114281 | * | 10/1978 |
| JP | 53-114281 | A | 10/1978 |
| JP | 2-276132 | A | 11/1990 |
| JP | 3-250547 | A | 11/1991 |
| JP | 4-272109 | * | 9/1992 |
| JP | 4-272109 | A | 9/1992 |
| JP | 5-283001 | * | 10/1993 |

(Continued)

*Primary Examiner*—Joseph L Williams
*Assistant Examiner*—Elmito Breval
(74) *Attorney, Agent, or Firm*—Foley & Lardner LLP

(57) ABSTRACT

A cold cathode fluorescent tube where an electron emitting electrode is sealed in shows much deterioration in the luminance with time, thereby being not adequate for a long time use. The electrode emitting electrode is formed in such a shape that an electric field is not locally concentrated. By mixing a material of high heat conductivity, such as tungsten, as the material for the electron emitting electrode or using helium of high heat conductivity as the sealing gas, a long life of the cold cathode fluorescent tube is achieved.

19 Claims, 13 Drawing Sheets

FOREIGN PATENT DOCUMENTS

| | | | |
|---|---|---|---|
| JP | 5-283001 | A | 10/1993 |
| JP | 2871499 | A | 7/1996 |
| JP | 3107743 | A | 4/1997 |
| JP | 11-120957 | A | 4/1999 |
| JP | 11-144677 | A | 5/1999 |
| JP | 2002/33049 | | 1/2002 |
| JP | 2002/124211 | | 4/2002 |
| JP | 2002/289139 | | 10/2002 |
| JP | 2004-14342 | A | 1/2004 |

* cited by examiner

FLUORESCENT LAMP AND METHOD OF MANUFACTURING SAME

CROSS-REFERENCE TO RELATED PATENT APPLICATIONS

Japanese Application 2003-040364, filed Feb. 18, 2003 including the specification, drawings, claims and abstract, is incorporated herein by reference in its entirety. This application is a U.S. National Stage of PCT/JP2004/001767, filed Feb. 18, 2004, including the specification, drawings, claims and abstract, is incorporated herein by reference in its entirety.

TECHNICAL FIELD

This invention relates to a fluorescent lamp and a method of manufacturing the fluorecent lamp and, more specifically, relates to a cold cathode fluorescent lamp having electron emitting electrodes and a method of manufacturing the cold cathode fluorecent lamp.

BACKGROUND ART

Generally, cold cathode fluorescent lamps of this type have been widely used in applications of backlights of liquid crystal displays and so on because it has a longer electrode life and is easily miniaturized as compared with a hot cathode fluorescent lamp using a filament. The cold cathode fluorescent lamp comprises, as generally depicted at symbol 100 in FIG. 13, a fluorescent lamp tube 101 in which a phosphor is applied to an inner surface thereof, a pair of opposing electron emitting electrodes 102, and lead wires 104 electrically connected to the electron emitting electrodes 102, respectively. The fluorescent lamp tube 101 is filled with a gas.

The fluorescent lamp tube 101 used in such a fluorescent lamp is normally formed by a glass tube and the electron emitting electrodes 102 are normally made of a low work function material, such as Ni, Ta, or Zr. Further, as the gas enclosed in the tube 101, a Hg—Ar—Ne mixed gas is normally used.

In manufacturing processes of manufacturing the cold cathode fluorescent lamp 100, the process of cleaning the tube 101 is essential. In the cleaning process of the tube 101, there has conventionally been employed a technique of feeding a cleaning liquid in one direction from one open end of the tube toward the other open end under a constant pressure, i.e. under a normal pressure.

When the cold cathode fluorescent lamp having the foregoing structure and manufactured by the foregoing technique is used in a liquid crystal display, there is a tendency that a cold cathode fluorescent lamp with a longer lifetime and a higher luminance is required following the spread of the liquid crystal displays.

In order to form the high-luminance cold cathode fluorescent lamp, it is quite important to reduce a cathode voltage drop that is generated near an electrode portion. Further, in order to reduce the cathode voltage drop, there has been widely adopted a hollow cathode structure that confines glow discharge inside a tubular electrode.

In order to further reduce the cathode voltage drop by the use of the hollow cathode, a method may be carried out which includes a simple step of applying a $R_2O_3$ type electron emission material to an inner surface of the hollow cathode to reduce an effective work function of the electrode, thereby reducing the cathode voltage drop, as disclosed in Japanese Patent No. 3107743 specification (hereinafter referred to as Reference Document 1).

However, only by applying the electron emission material to the inner surface of the hollow cathode as shown in Reference Document 1, since the thermal conductivity of the electrode material is poor, $La_2O_3$ or the like being an electron emission substance evaporates to reduce the electrode life.

According to researches of the present inventors, when the tubular hollow cathode was employed, a phenomenon was observed at the start of discharge that an electric field was concentrated to an open end portion of the tube so that the electrode was sputtered. It has been found that the life of the electrode is shortened as a result of the concentration of the electric field.

Further, it has also been found that since the lead wire for supplying a voltage to the electrode is joined to the electrode by welding, a thermal resistance is generated at the joining interface and thus the heat conduction is not efficiently carried out. Further, since use is made of Ar and Ne each having a poor thermal conductivity as the noble gas components in the filled gas, the heat radiation from the electrode is not efficiently carried out so that the electrode temperature rises to reduce the electrode life.

Reviewing also the manufacturing processes, it has been found that since, in the tube cleaning process among the manufacturing processes, the cleaning liquid is delivered in the single direction and further under the constant pressure, the inside of the thin and long tube cannot be sufficiently cleaned to thereby cause a problem of adhesion failure and uneven application of the phosphor, which also reduces the life of the cold cathode fluorescent lamp.

Further, it has also been found that moisture and oxygen remaining inside the tube reduce the electrode life. With respect to the residual moisture, it has been found that there is a problem in a drying method after the cleaning. With respect to the residual oxygen, it has been found that there is a problem in an exhaust method at the time of seal-cutting the tube.

In a drying method after the cleaning, moisture inside the tube is desorbed by raising a temperature in the atmosphere. However, a problem has occurred wherein the atmospheric components enter the tube when the drying is finished and the tube is cooled, so that moisture in the atmosphere adsorbs again inside the tube.

With respect to the exhaust method at the time of the seal cutting, it has been found that since the tube is long, a pressure difference occurs inside the tube during exhausting so that the gas components inside the tube are not completely exhausted. Further, a problem has occurred wherein the components on the exhaust side of an exhaust pump are diffused back to the inside of the tube so that oxygen remains.

Therefore, it is an object of this invention to provide a fluorescent lamp, particularly a cold cathode fluorescent lamp, that can improve the light emission efficiency by improving the electron emission efficiency and that has a long lifetime.

It is another object of this invention to provide a fluorescent lamp manufacturing method that can achieve an increase in lifetime of a fluorescent lamp, an improvement in luminance, and uniformization of luminance.

It is a specific object of this invention to improve a tube cleaning process in the manufacture of a fluorescent lamp.

It is another specific object of this invention to improve a method and apparatus for drying the inside of a cold cathode lamp tube in the manufacture of a fluorescent lamp, thereby improving the life of an electrode.

It is still another specific object of this invention to improve a method of exhausting a gas inside a cold cathode lamp tube in the manufacture of a fluorescent lamp, thereby improving the life of an electrode.

DISCLOSURE OF THE INVENTION

In order to accomplish the foregoing objects and increase the life of a fluorescent lamp, particularly a cold cathode fluorescent lamp, according to one aspect of this invention, there is provided a fluorescent lamp characterized in that at least a tip portion of an electron emitting electrode is made of a mixture of at least one material selected from the group consisting of $La_2O_3$, $ThO_2$, and $Y_2O_3$ and tungsten (W). A portion, contacting a tube, of the electron emitting electrode is made of a material (e.g. W) excellent in adhesion with the tube and excellent in thermal conductivity and this portion does not need to be added with the foregoing selected material.

It is preferable that a lead wire for supplying a voltage to the electrode be made of the same material as that of at least a portion, continuous with the lead wire, of the electron emitting electrode.

According to another aspect of this invention, there is provided a fluorescent lamp which comprises an electron emitting electrode having a hollow cathode structure. This aspect is characterized in that an open tip portion of the electron emitting electrode has an obtuse angle shape or a curved shape. In this case, the tip portion may be rounded, may have a shape substantially defined by a hyperbolic function, or may have a shape defined by a curve other than a hyperbolic function. However, the tip portion preferably has the shape substantially defined by the hyperbolic function. Further, it is preferable that a portion contacting an inner wall bottom surface of the hollow cathode be formed into an obtuse angle shape or a curved shape, i.e. not into a perpendicular shape. This is because plasma is generated inside the hollow cathode.

It is desirable that at least the open tip portion of the electron emitting electrode having the foregoing shape be formed by using a mixture of at least one material selected from the group consisting of $La_2O_3$, $ThO_2$, and $Y_2O_3$ and a material, such as W, having a low resistance, a high thermal conductivity, and a high melting point.

In this invention, the content of $La_2O_3$, $ThO_2$, or $Y_2O_3$ at the portion where $La_2O_3$, $ThO_2$, or $Y_2O_3$ is contained is, in weight %, 1.0 to 10.0%, and preferably 5 to 7%. Alternatively, it is preferable that at least one of $La_2O_3$, $ThO_2$, and $Y_2O_3$ be contained, in a volume ratio, at 0.001 to 0.05 and more preferably at 0.01 to 0.1 relative to W. In this manner, the whole or at least the electron emitting portion of the electron emitting electrode is substantially formed by W containing one or more of $La_2O_3$, $ThO_2$, and $Y_2O_3$, but there may be those instances where a resin component at the time of manufacturing the electrode is contained at 1 vol % or less.

Further, according to still another aspect of this invention, there is provided a fluorescent lamp in which a tube is filled with a gas, characterized in that the gas contains one or both of He and $H_2$.

According to yet another aspect of this invention, there is provided a method of manufacturing a fluorescent lamp including a step of cleaning in the state where the inside of a tube is filled with a cleaning liquid. The aspect is characterized in that the cleaning step performs the cleaning by reciprocating the cleaning liquid in the tube. The cleaning is preferably performed at a pressure higher than a normal pressure. That is, it is preferable that the pressure of the cleaning liquid with respect to the inner surface of the tube exceed 1 kgf/cm$^2$.

According to a further aspect of this invention, there is provided a method of manufacturing a fluorescent lamp characterized by feeding a dry gas having a small moisture concentration at the time of drying the inside of a tube.

According to a still further aspect of this invention, there is provided a method of manufacturing a fluorescent lamp including a step characterized by performing a cyclic purge at the time of exhausting the inside of a tube, the method characterized by purging a dry nitrogen gas into a purge port provided on the exhaust side of a primary pump such as a turbomolecular pump.

Herein, in this invention, the foregoing fluorescent lamp is preferably used as a cold cathode fluorescent lamp.

BEST MODE FOR CARRYING OUT THE INVENTION

Hereinbelow, an embodiment of this invention will be described.

Figure 1:
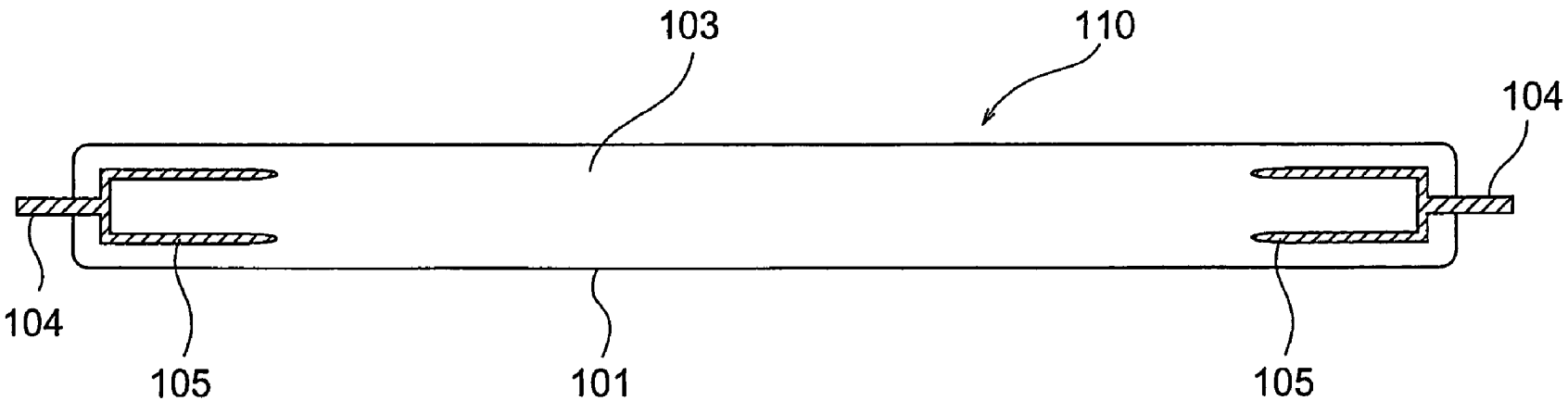
FIG. 1 is a sectional view showing a cold cathode fluorescent lamp according to an embodiment of this invention.
Figure 13:
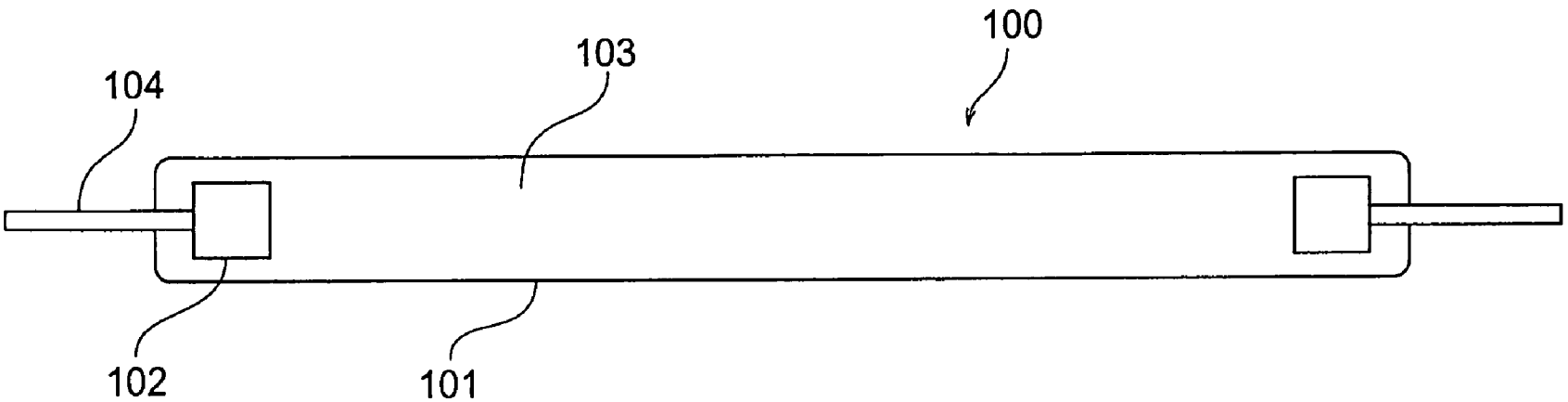
FIG. 13 is a sectional view for use in explaining a conventional cold cathode fluorescent lamp.

As shown in FIG. 1, a cold cathode fluorescent lamp 110 according to this invention includes a tube 101, a pair of electron emitting electrodes 105 disposed at both ends of the tube 101 so as to face each other and each having a sectional shape different from that of the electron emitting electrode 102 shown in FIG. 13, and electrode lead wires 104 connected to the electron emitting electrodes 102, respectively. The tube 101 is filled with a filler gas 103.

Specifically, the illustrated tube 101 of the cold cathode fluorescent lamp 110 is made of glass. A material forming the electron emitting electrodes 105 is in the form of tungsten (W) having a high thermal conductivity and containing $La_2O_3$ having a small work function. In other words, the illustrated electron emitting electrodes 105 are each formed by a mixture of $La_2O_3$ and W. The addition of $La_2O_3$ to W is carried out only at a tip portion of each electrode while its seal portion with the glass is made of only W. That is, the electron emissive material such as $La_2O_3$ is added at the electrode tip portion that contributes to electron emission, while only W is used at the portion, such as the seal portion with the glass or the like, where no contribution to electron emission is required. It is preferable to use $La_2O_3$ only at the electrode tip portion in this manner because it is possible to improve the thermal conductivity and suppress temperature rise at the electrode as compared with the case where $La_2O_3$ is added over the whole electrode. Naturally, it is possible to add $La_2O_3$, $ThO_2$, or $Y_2O_3$ over the whole electrode. In this case, the manufacture is facilitated.

Further, the lead wire 104 is formed integral with at least the glass seal portion of the electron emitting electrode 105. As the filler gas 103 enclosed in the tube 101, use is made of a mixed gas in which He is contained in a Hg—Ar gas.

The composition of the filler gas may be, other than the foregoing, a mixed gas of argon, neon, and helium (Ar/Ne/He) or a mixed gas of argon, neon, and hydrogen (Ar/Ne/$H_2$). The He or $H_2$ ratio relative to Ar/Ne is preferably, by volume, 1 to 10%.

Like helium gas, hydrogen gas has a high thermal conductivity. Therefore, the temperature is not accumulated and plasma is concentrated so that electron recombination at a wall of a glass tube or a phosphor is suppressed and, therefore, the excitation efficiency of mercury is improved and thus luminance is improved. Further, the hydrogen gas has an effect of preventing oxidation of electrodes caused by unavoidable moisture generated at the time of glass burn cutting (seal cutting) in the state where an atmosphere in a fluorescent tube is set to a reducing atmosphere.

As also clear from FIG. 1, each electron emitting electrode 105 has a hollow cathode structure and an edge portion of its open tip portion is ground by the grinding method so as to be rounded.

Figure 2:
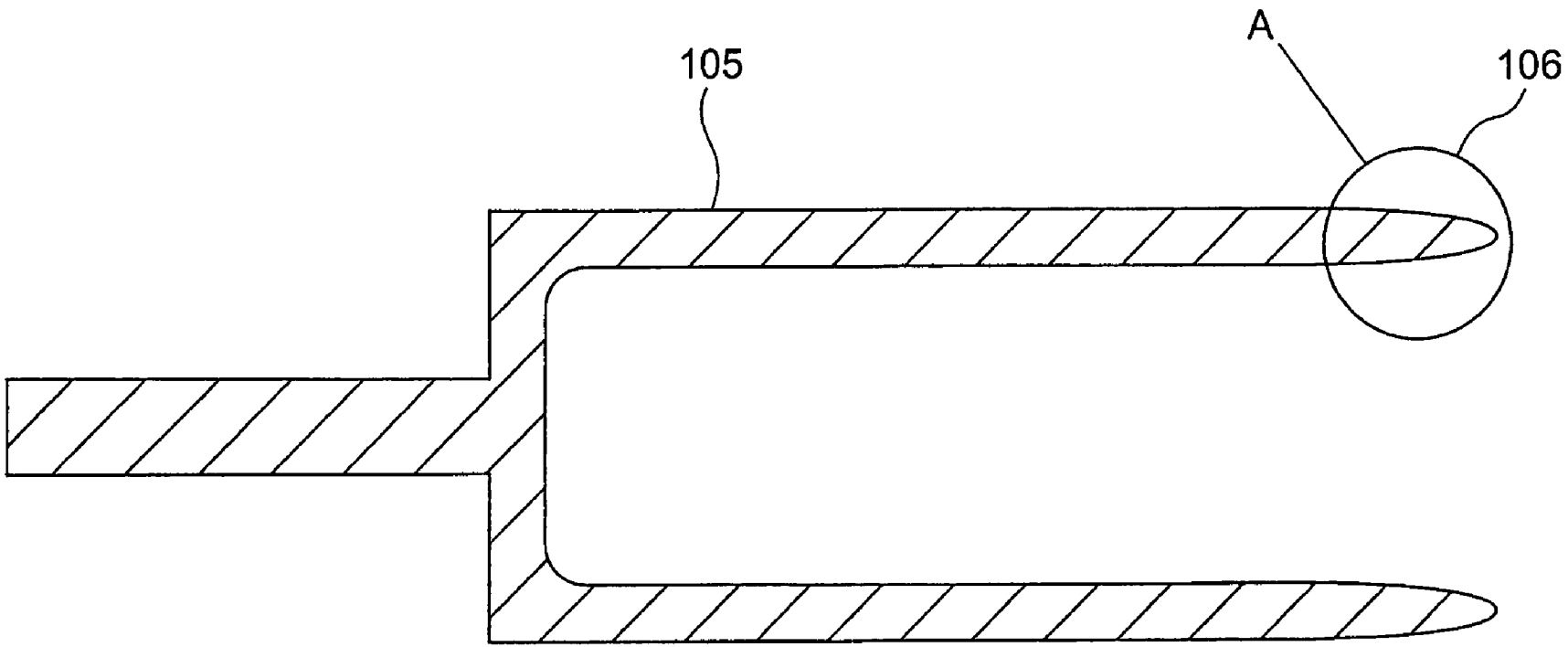
FIG. 2 is a sectional view for use in explaining in more detail an electron emitting electrode of the cold cathode fluorescent lamp shown in FIG. 1.

Here, referring also to FIG. 2, the electron emitting electrode 105 having the hollow cathode structure of a U-shape in section has a rounded open tip portion 106. The illustrated open tip portion 106 is formed into a shape defined by a hyperbolic function. In the illustrated example, the tip shape depicted by "A" after the grinding has a hyperbolic function shape with a radius r of 0.1 mm.

A method described in U.S. Pat. No. 2,871,499 specification (hereinafter referred to as Reference Document 2) or the like was applied to the electron emitting electrodes 105 obtained by the grinding to thereby manufacture the cold cathode fluorescent lamp 110. In this case, the mixed gas of Hg—Ar and He was filled as the filler gas 103. Further, as shown in the figure, an inner bottom surface was also formed to exhibit an obtuse angle or a curved surface.

It is preferable that an electron emissive material with a low work function be added to a material, such as W, having a low resistance, a high thermal conductivity, and a high melting point.

Table 1 below shows the properties of various materials.

TABLE 1

| | Melting Point (° C.) | Boiling Point (° C.) | Work Function (eV) | Electrical Resistivity ($10^{-6}$ Ω cm) | Thermal Conductivity (300K) ($10^{-3}$ W/m · K) |
|---|---|---|---|---|---|
| W | 3400 | 5700 | 4.6 | 5.65 | 178 |
| Ta | 2990 | 5400 | 4.15 | 12.45 | 57.5 |
| Th | 1750 | 4800 | 3.4 | 13.0 | 49.1 |
| La | 921 | 3500 | 3.5 | 5.7 | 13.5 |
| Ce | 799 | 3400 | 2.9 | 75.0 | 11.4 |
| Nb | 2470 | 4700 | 4.3 | 12.5 | 53.7 |
| Y | 1520 | 3300 | 3.1 | 57.0 | 16.2 |
| Al | 660 | 2470 | 4.28 | 2.65 | 237 |
| Cu | 1083 | 2570 | 4.65 | 1.67 | 398 |
| $ThO_2$ | 3220 | 4400 | 1.66-6.32 | $2.6 \times 10^{13}$ | 13.2 |
| $La_2O_3$ | 2307 | 4200 | 2.8-4.2 | | |
| $Y_2O_3$ | 2410 | 4300 | 2.0 | | 12-13 |

From Table 1 above, it is understood that $ThO_2$, $La_2O_3$, or $Y_2O_3$ can be used along with W. Specifically, the content of the electron emission material, such as $La_2O_3$ is, by weight, 1 to 10% and preferably 5 to 7%. Within this range of the content, the plasma density near the electrode increases due to electron emission from the electron emission material so that the plasma potential decreases. This reduces irradiation energy of ions flowing to the electrode from the plasma so that sputtering of the electrode is reluctant to occur. This makes it possible to suppress blackening of the tube wall around the electrode caused by the electrode material so that the life of the cold cathode lamp can be improved. Although the electron emissivity is improved by adding $La_2O_3$, $ThO_2$, or $Y_2O_3$, since $La_2O_3$, $ThO_2$, or $Y_2O_3$ itself has a high electrical resistance and a low thermal conductivity, a problem of voltage drop arises at the electrode, evaporation of the electron emission material, and so on. In view of this, the foregoing concentration is preferable.

Naturally, the tip of the electrode is not necessarily long. Following the increase in size of liquid crystal display devices and so on in which cold cathode lamps are used, the total lengths of the cold cathode lamps have been increasing. In order to increase the substantial light emission length with respect to the total length of the cold cathode lamp, a shorter hollow cathode length is better and, even in this case, the foregoing effect can be achieved. In the illustrated example, the outer diameter is 1.7 mm, the inner diameter 1.4 mm (side thickness 0.3 mm), and the length 4.2 mm. However, the length may be shortened to, for example, 1.0 mm.

As described above, by the use of the mixture of tungsten (W) excellent in thermal conductivity and $La_2O_3$ having the small work function as the material of each electron emitting electrode 105 like in the cold cathode fluorescent lamp according to the embodiment of this invention, the heat generated at the electron emitting electrode 105 can be efficiently discharged to the exterior of the fluorescent lamp and, therefore, the evaporation of the electron emission material can be suppressed so that the electrode life can be prolonged.

Further, since each electron emitting electrode 105 used in the cold cathode fluorescent lamp 110 is formed integral with the voltage supply lead wire 14 according to this embodiment, this also improves the heat conduction efficiency so that the evaporation of the electron emission material from the electron emitting electrode 105 can be suppressed.

Figure 3B:
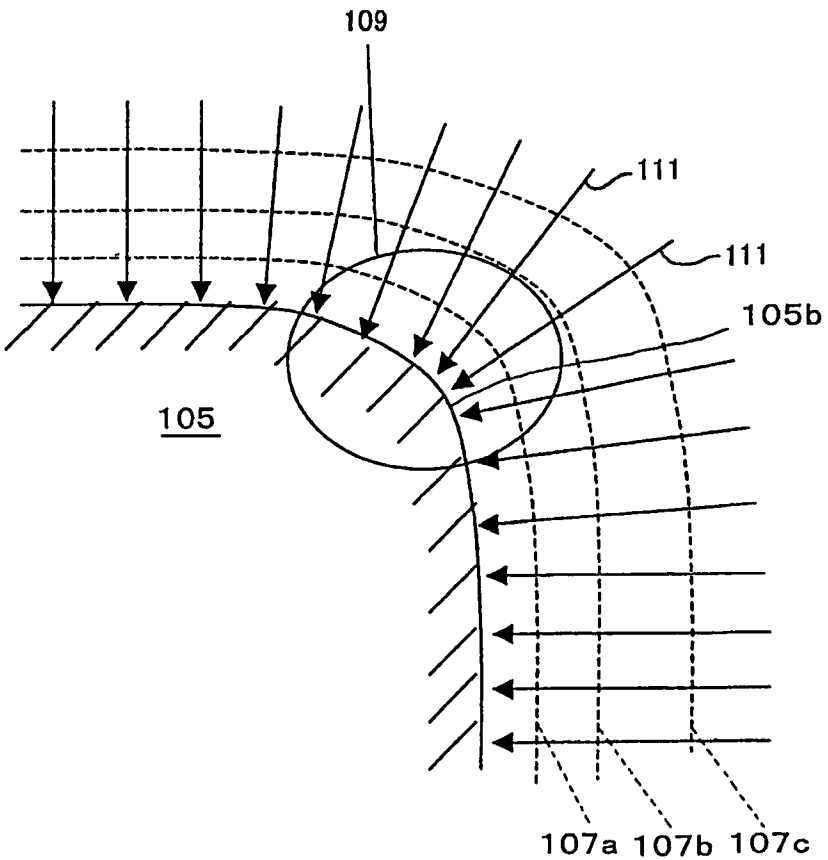
FIG. 3B is a schematic diagram showing relaxation of electric field concentration at a cold cathode having a hyperbolic function shape.
Figure 3A:
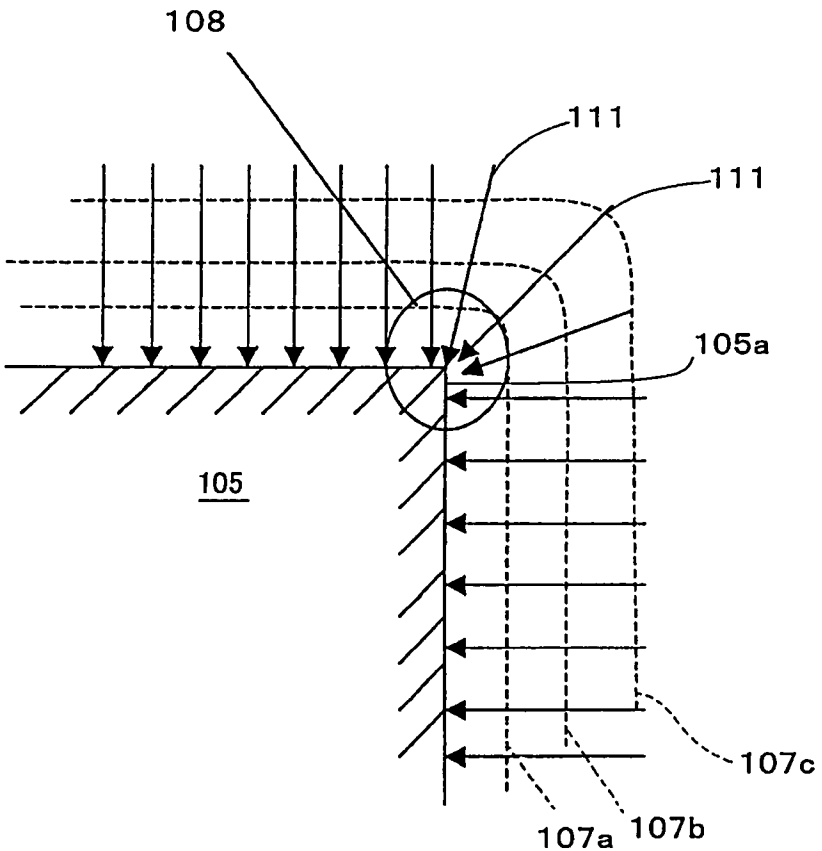
FIG. 3A is a schematic diagram showing a state of electric field concentration at a cold cathode having a normal shape.
Figure 4:
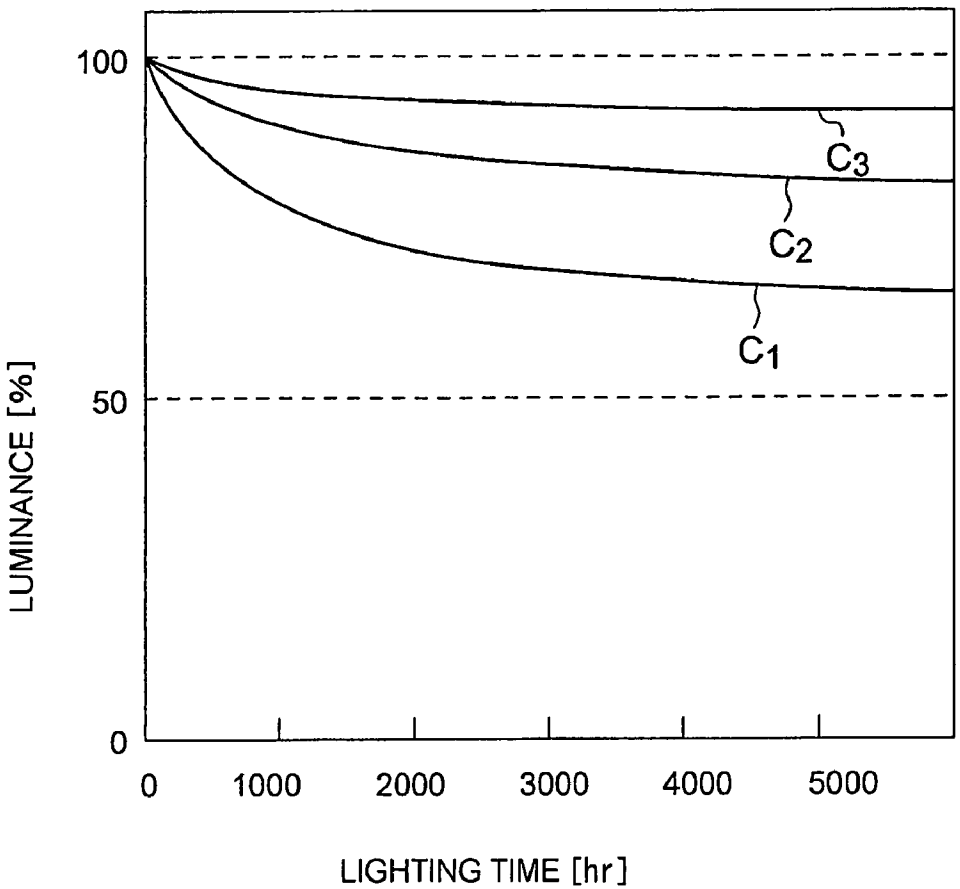
FIG. 4 is a graph for use in comparing and explaining the properties of the cold cathode fluorescent lamp according to this invention and the properties of a conventional cold cathode fluorescent lamp.

Further, sputtering due to electric field concentration at the time of lighting can be suppressed by forming the shape of the open tip portion of each electron emitting electrode 105 to follow the hyperbolic function. This also makes it possible to prolong the electrode life. The hyperbolic function will be described in more detail on the basis of FIGS. 3A and 3B. Referring to FIGS. 3A and 3B, it has been made clear based on researches by the present inventors that equipotential surfaces 107 (107*a*, 107*b*, 107*c*) having hyperbolic function shapes are generated around the electrode 105. When the electrode shape is formed parallel to the equipotential surfaces 107*a*, 107*b*, and 107*c*, the electric field concentration can be most relaxed to enable uniform electron emission over the whole surface of the electrode. Note that symbol 111 denotes electric force lines. Therefore, in order to effectively maximize the electron emission area, it is preferable that the shape of an electrode edge portion 105 be set to a hyperbolic function shape as shown in FIG. 3B. Since the electric field concentration is reluctant to occur by setting the shape of the electrode tip portion to the hyperbolic function shape, it is possible to suppress blackening of the tube wall around the electrode due to the electrode material, which is caused by sputtering of the electrode when a current flows locally to the electrode edge or the like. Accordingly, the life of the cold cathode lamp can be improved.

Further, not only the open tip portion of the electron emitting electrode 105 but also the bottom surface of the electron emitting electrode 105 may be rounded. The roundness at this bottom surface can also be conformed to a shape following a hyperbolic function. When the shape following the hyperbolic function is given to the open tip portion or the bottom surface in this manner, the local concentration of the electric field can be prevented. As a result, the electrode sputtering phenomenon can be suppressed. Normally, when the electrode is sputtered, the electrode material adheres to the glass tube wall and the Hg gas adheres thereto, thereby causing a reduction in luminance. On the other hand, since the sputtering phenomenon can be suppressed in the case of the electron emitting electrode according to the embodiment of this invention, it is possible to prevent the electrode material from adhering to the glass tube wall. As a result, the reduction in luminance can be suppressed.

Next, since He having a large heat capacity and excellent in thermal conductivity is mixed in the filler gas 103 of the cold cathode fluorescent lamp according to this embodiment, it is possible to narrow a path of a discharge current. As a result, it is possible to suppress a reduction in luminance caused by collision of electrons with the wall of the tube 101 so as to be absorbed. Therefore, the light emission luminance can be improved.

By the use of relationships between lighting time and luminance change, comparison was made between the life of the cold cathode fluorescent lamp having the foregoing structure and the life of the conventional cold cathode fluorescent lamp. As shown by a curve $C_1$, in the case of the conventional cold cathode fluorescent lamp, the luminance decreases to about 90% when a lighting time is 100 hours and, with a lapse of 1000 hours, the luminance becomes 80% or less. On the other hand, as shown by a curve $C_2$, in the case of using the electron emitting electrodes 105 of this invention made of the material containing W and $La_2O_3$, the luminance keeps 90% even when a lighting time reaches 1000 hours. Further, as shown by a curve $C_3$, in the case of using the electron emitting electrodes 105 each having the hyperbolic function shape at its open tip portion and made of W and $La_2O_3$, the luminance keeps 95% even when a lighting time exceeds 1000 hours. Even when the open tip portion has an obtuse angle shape or a general curved shape, an excellent effect can be obtained.

Therefore, it is understood that the life of the cold cathode fluorescent lamp is improved by causing tungsten (W) to be contained in the electron emitting electrodes and is further improved by also setting the shape of the open tip portion to the obtuse angle shape or the curved shape.

Further, as a result of performing a continuous lighting on and off test, in the case of the cold cathode fluorescent lamp according to this invention, since the sputtering generated at the time of lighting can be suppressed, it was possible to largely extend the life as compared with the conventional cold cathode fluorescent lamp.

With respect to the electron emitting electrode 105 integral with the lead wire 104 as shown in FIGS. 1 and 2, the description has been made of the method of obtaining the hyperbolic function shape by carrying out the grinding after the molding. The electron emitting electrode 105 can be formed by the use of MIM (Metal Injection Molding) as will be described below. In this case, at first, tungsten alloy powder containing 3% $La_2O_3$ in volume ratio and styrene as resin powder were mixed and kneaded at 0.5:1 in weight ratio and, further, Ni was slightly added as a sintering assistant, thereby obtaining a tungsten alloy pellet. In this case, the size of the tungsten alloy powder was set to about 1 μm. Using the thus obtained pellet, the injection molding (MIM) was carried out by the use of a die formed into the shape of the electron emitting electrode 105. The injection molding temperature was set to a temperature at which the injection was enabled and, in this example, 150° C.

Then, the molded product obtained by the injection molding was heated in hydrogen to thereby perform degreasing. In this event, the heating temperature was gradually raised from 500° C. to 900° C. and, thereafter, burning was carried out at 1600° C. for one hour. After the burning, it was annealed and then taken out so that the electrode was completed. Ni added as the sintering assistant can lower the sintering temperature of the MIM sintered body.

In the foregoing embodiment, the description has mainly been made of the structure and the manufacturing method of the electron emitting electrode 105. However, it has been found that an increase in lifetime of the cold cathode fluorescent lamp can also be realized by improving a cleaning process of the tube 101 among manufacturing processes of the cold cathode fluorescent lamp. Herein, referring to FIG. 5, description will be given of a method and apparatus for cleaning the inside of the tube 101 of the cold cathode fluorescent lamp according to this invention. The illustrated cleaning apparatus comprises a pair of tube support portions 201 that support both ends of a plurality of tubes 101. A cleaning liquid from a cleaning liquid reservoir 202 is supplied to the inside of the tubes 101 attached to the tube support portions 201, through cleaning liquid supply portions 203 and cleaning liquid supply pipes 204. An ultrasonic wave irradiation portion 206 is provided between the illustrated tube support portions 201 and the tubes 101 are cleaned in the state where an ultrasonic wave is irradiated at the ultrasonic wave irradiation portion 206.

In the illustrated example, the cleaning liquid supply portions 203 and the cleaning liquid supply pipes 204 are provided at both sides of the tube support portions 201 and, among them, the two cleaning liquid supply portions 203 are connected to a control portion 205 via signal lines and perform operations of delivering and sucking the cleaning liquid under the control of the control portion 205. Each cleaning liquid supply portion 203 has a structure of enabling forward and reverse rotation of a transfer pump for pressure delivery and sucking of the cleaning liquid. In this structure, under the control of the control portion 205, the cleaning liquid from the cleaning liquid reservoir 202 is supplied into the tubes 101 attached to the tube support portions 201 at a pressure higher than a normal pressure, i.e. at a pressure where a liquid pressure at the inner surfaces of the tubes exceeds 1 kgf/cm$^2$, and is reciprocated leftward and rightward, thereby cleaning the inside of the tubes 101.

In the case of this example, the cleaning liquid was supplied to the tubes 101 at a delivery pressure of 0.5 kgf/cm$^2$. The delivery pressure is not limited to the foregoing value as long as it is within a range that can maintain a mechanical strength of the tubes 101 subjected to the cleaning.

Figure 5:
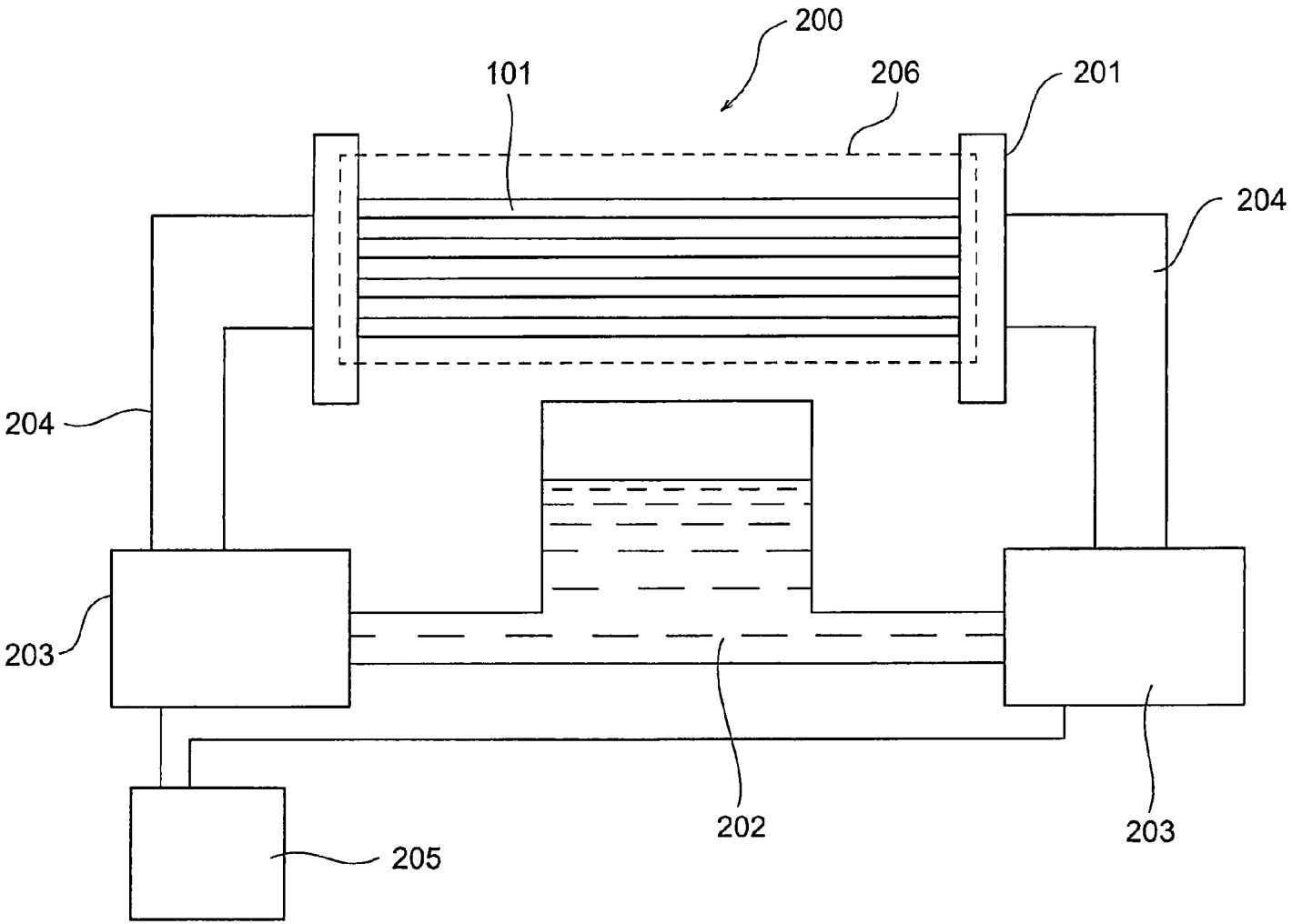
FIG. 5 is a block diagram for use in explaining a cleaning method and a cleaning apparatus for the cold cathode fluorescent lamp according to this invention.

By the use of the cleaning apparatus 200 shown in FIG. 5, the cold cathode fluorescent lamp tube 101 having an inner diameter of 4 mm and a length of 70 cm was cleaned, and the organic matter adsorption amounts inside the tube 101 before and after the cleaning were measured by the heat-desorption gas chromatography-mass spectrometry.

Figure 6:
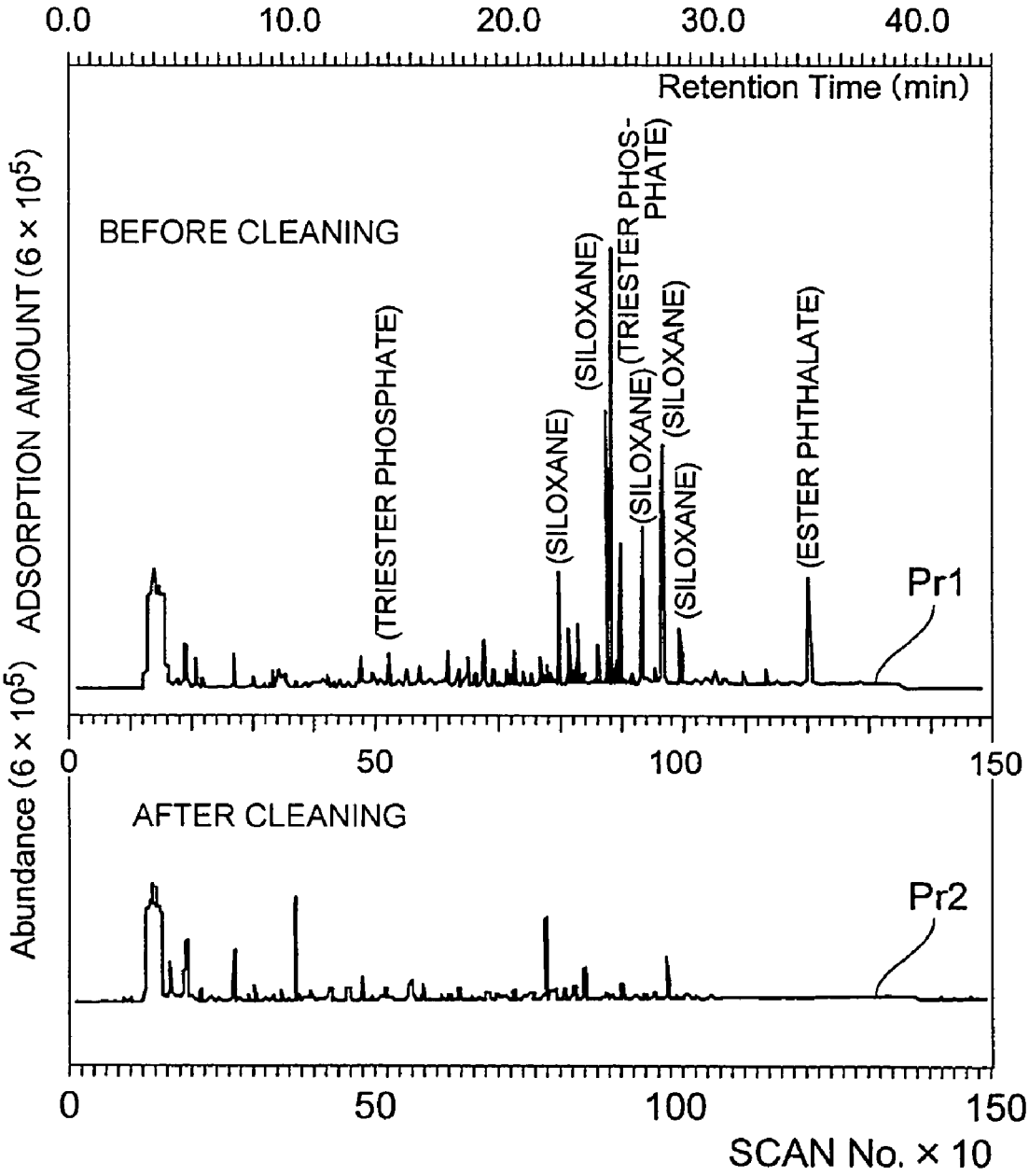
FIG. 6 is a graph for use in explaining an effect achieved by cleaning shown in FIG. 5.

Referring to FIG. 6, there are shown spectra of the organic matter adsorption amounts before and after the cleaning, wherein Pr1 shows them before the cleaning while Pr2 shows them after the cleaning. It is understood that the adsorbed organic matter was removed by the foregoing cleaning and thus a sufficient cleaning effect was obtained. As a result of applying a phosphor to the inside of the thus cleaned tube 101, uneven application or the like was suppressed so that it was possible to uniformly apply the phosphor.

In the foregoing embodiment, the description has been made of the method of cleaning the inside of the tube. However, it has been found that the life of the cold cathode fluorescent lamp 110 can also be improved by a subsequent drying method. Herein, description will be made of a method and apparatus for drying the tube 101 of the cold cathode fluorescent lamp according to this invention.

Figure 7:
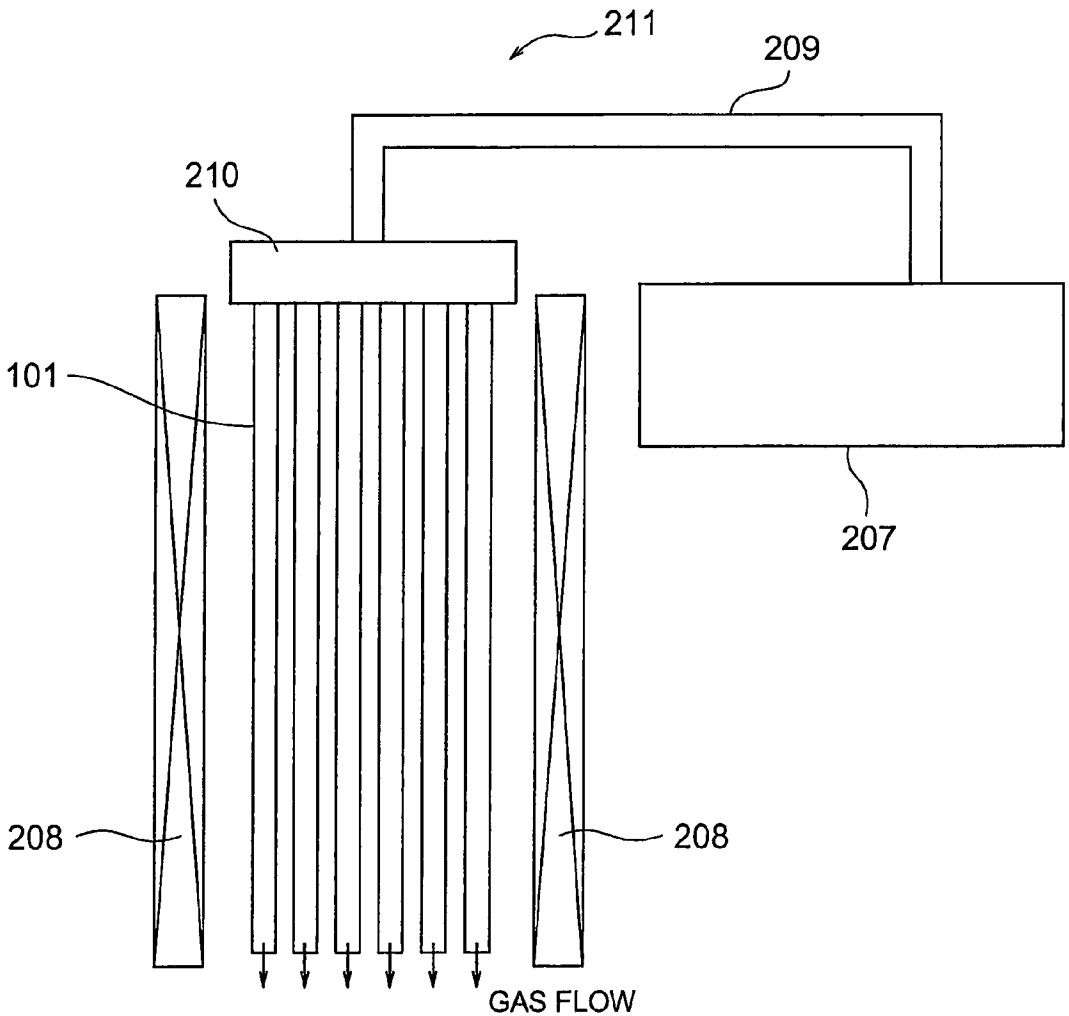
FIG. 7 is a schematic structural diagram showing a drying apparatus according to this invention.

FIG. 7 is a schematic diagram showing a tube drying apparatus which comprises a heater 208 for heating the tubes 101, a tube support portion 210 for supporting the tubes 101, and a gas supply portion 207 for feeding a dry gas to the inside of the tubes 101 through the tube support portion 210. The gas supply portion 207 and the tube support portion 210 are connected to each other through a pipe 209. Further, the tube support portion 210 is connected so as to enable the dry gas to flow into the inside of the tubes 101. It is sufficient that the tube support portion 210 supports at least one end of an opening of each tube 101. It is sufficient that the heater 208 can heat the tubes 101 to a temperature that evaporates moisture adsorbed to the inner walls of the tubes 101 and it is preferable that the heater 208 can heat them to 100° C. or higher. As the dry gas, use may be made of a gas, such as a dry nitrogen gas or a dry clean air (produced by CDASS-mini manufactured by Takasago Thermal Engineering Co., Ltd.), having a moisture concentration sufficiently smaller than that of a normal air.

By the use of this drying apparatus 211, the cold cathode fluorescent lamp tube 101 having an inner diameter of 4 mm and a length of 70 cm was dried, and the moisture adsorption amounts on the inner wall of the tube before and after the drying by this apparatus were analyzed by the atmospheric pressure ionization mass spectrometry (APIMS). The tube heating temperature was set to 250° C. and a $N_2$ gas (residual moisture concentration 0.2 ppb) was delivered at a flow rate of 50 cm$^3$/min for 5 minutes. As a result of the drying, the adsorbed moisture, which was $4\times10^{16}$ molecules/cm$^2$ before the drying, became $2\times10^{14}$ molecules/cm$^2$ equal to or less than a single molecular layer adsorption. It has been found that the reduction in residual moisture concentration can suppress evaporation of the electrode caused by oxidation to thereby improve the electrode life.

It has been found that the electrode life can be improved not only by the foregoing drying process but also by an exhaust method in an exhaust process. In the exhaust process of a cold cathode fluorescent lamp, since a tube is long and one side thereof is sealed, a problem arises that a pressure difference occurs inside the tube so that the exhaust is not sufficiently carried out. Description will be given of an exhaust method in the manufacturing processes of the cold cathode lamp according to this invention.

Figure 8:
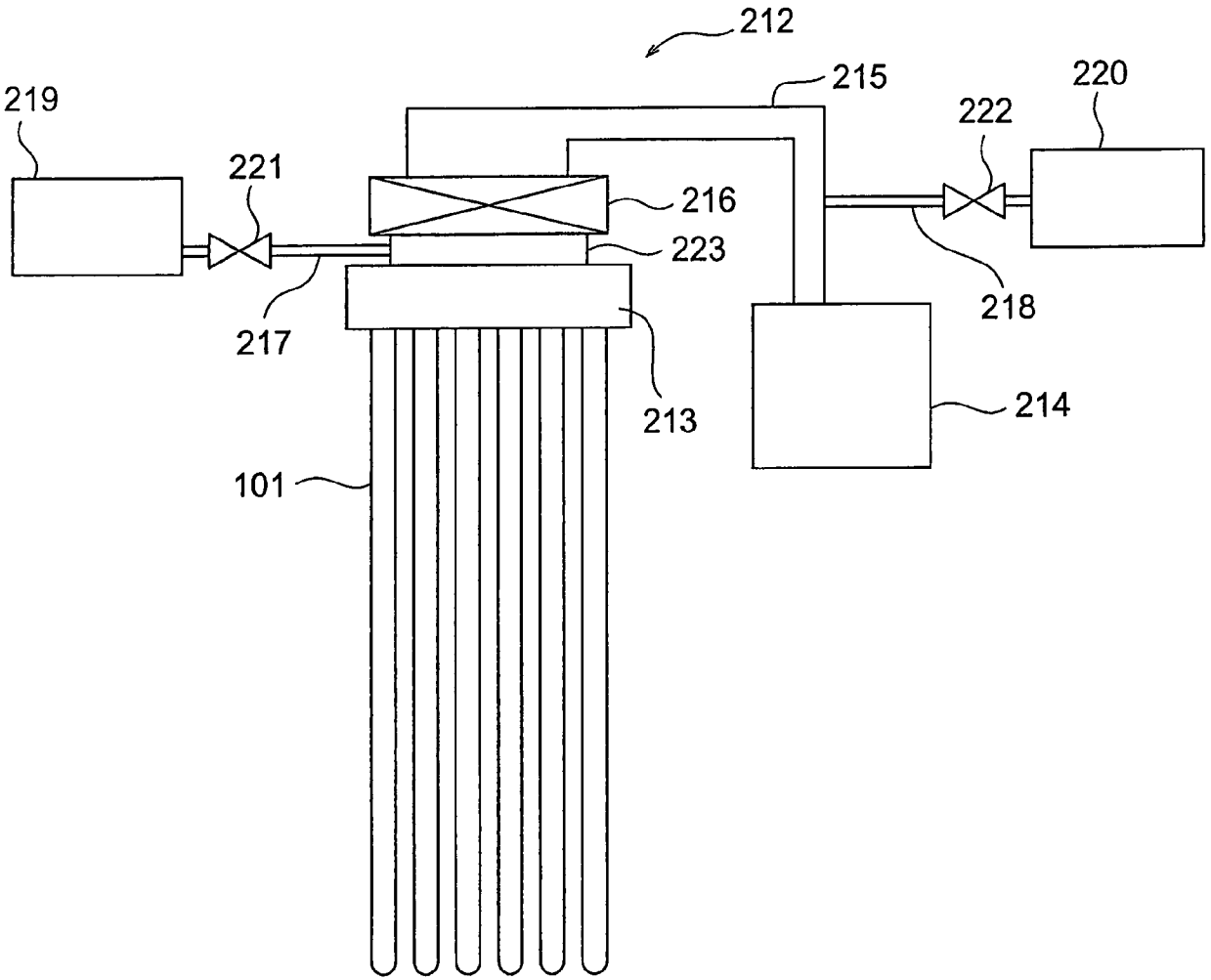
FIG. 8 is a schematic structural diagram for use in explaining an exhaust method and an exhaust apparatus according to this invention.

As shown in FIG. 8, the exhaust method and an exhaust apparatus 212 are formed by the cold cathode lamp tubes 101 being exhaust objects, an exhaust pump 214, a gate valve 216 provided upstream of the exhaust pump 214, a first purge port 217 provided on the side, opposite to the exhaust pump 214, of the gate valve 216, a second purge port 218 provided on the exhaust pump 214 side of the gate valve 216, and first and second gas supply portions 219 and 220 connected to the purge ports 217 and 218, respectively. The first and second purge ports are provided with valves 221 and 222, respectively.

Figure 9:
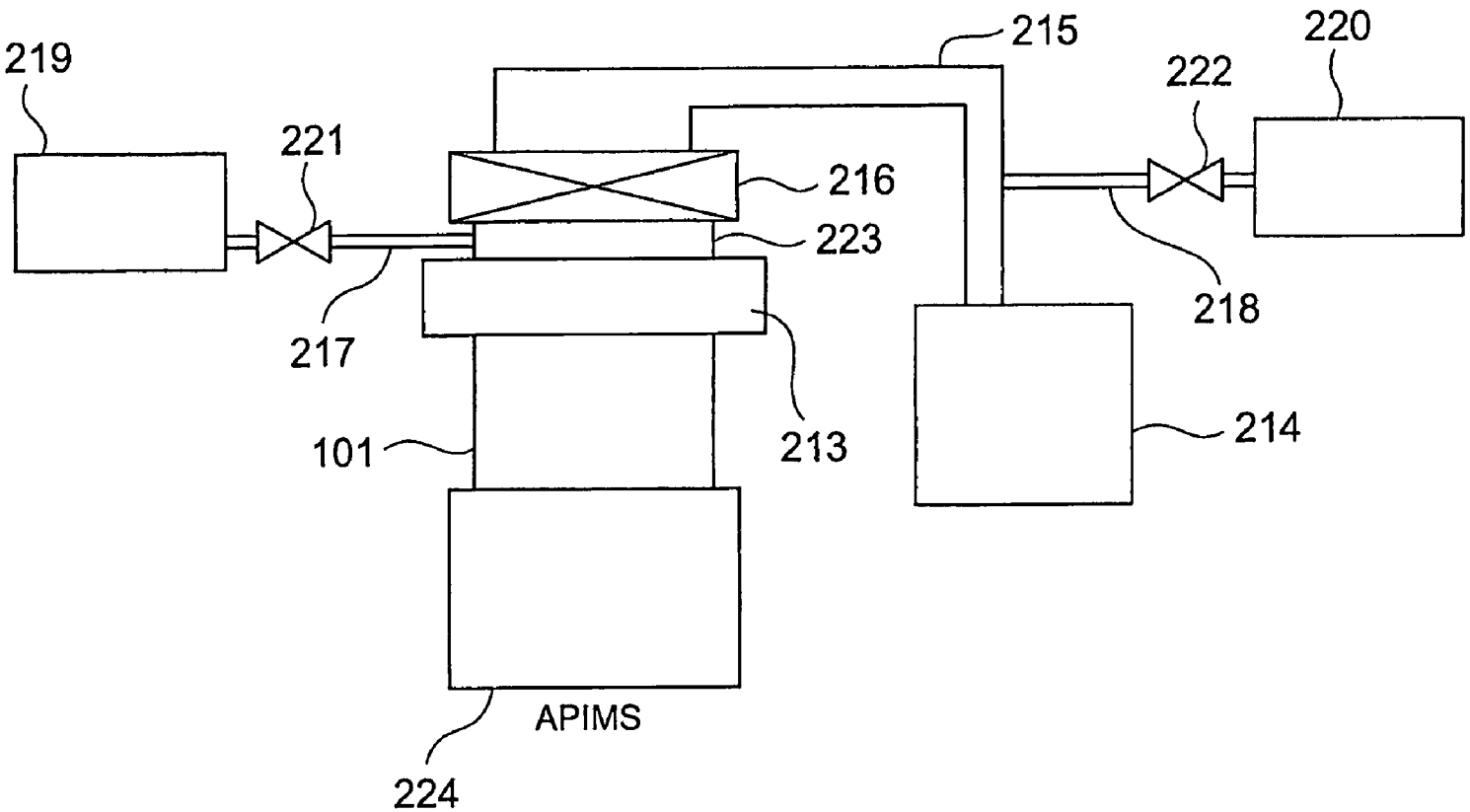
FIG. 9 is a diagram for use in explaining a case where the exhaust is carried out by connecting an atmospheric pressure ionization mass spectrometer system (APIMS)
Figure 10:
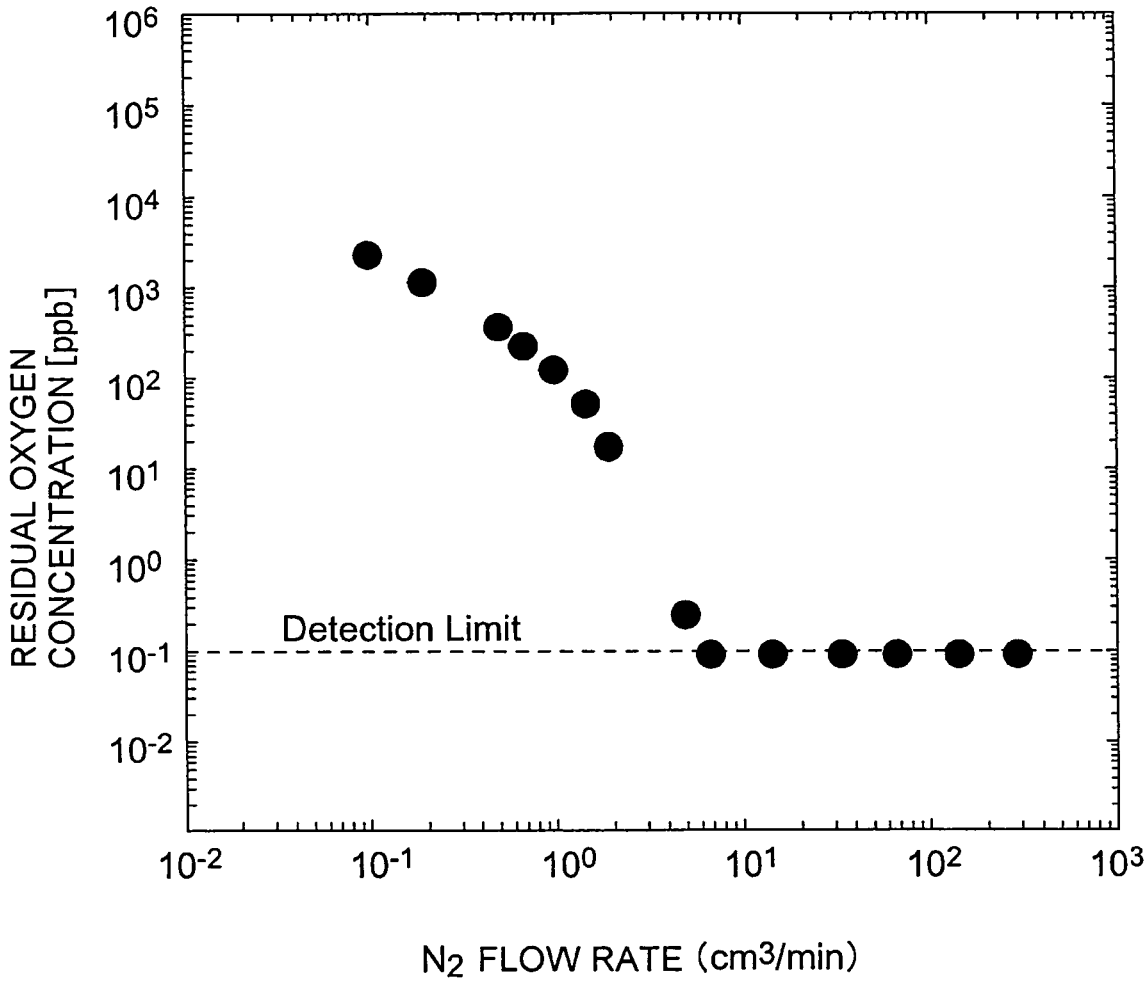
FIG. 10 is a graph showing results of measurement based on FIG. 9.

FIG. 10 shows results obtained by measuring the oxygen concentration by connecting an atmospheric pressure ionization mass spectrometer system (APIMS) 224 in place of the exhaust-object cold cathode lamp tubes 101 as shown in FIG. 9. It has been found that when the flow rate of nitrogen gas supplied to the second purge port 218 becomes 10 cm$^3$/min or more, the oxygen concentration decreases to the measurement lower limit.

Figure 11:
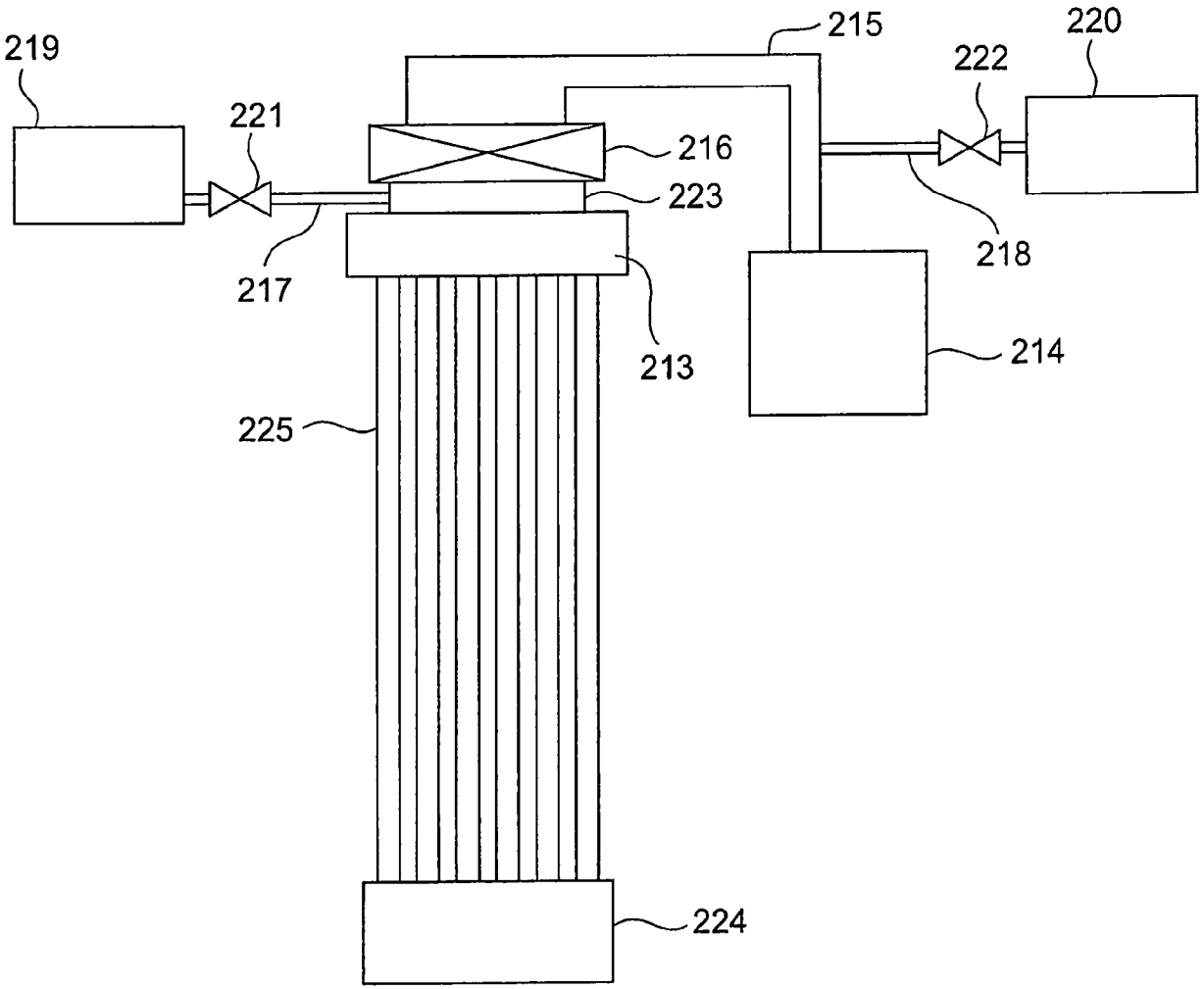
FIG. 11 is a diagram for use in explaining a case where stainless pipes are connected and the APIMS is connected to an end opposite to the exhaust side to carry out the exhaust.
Figure 12:
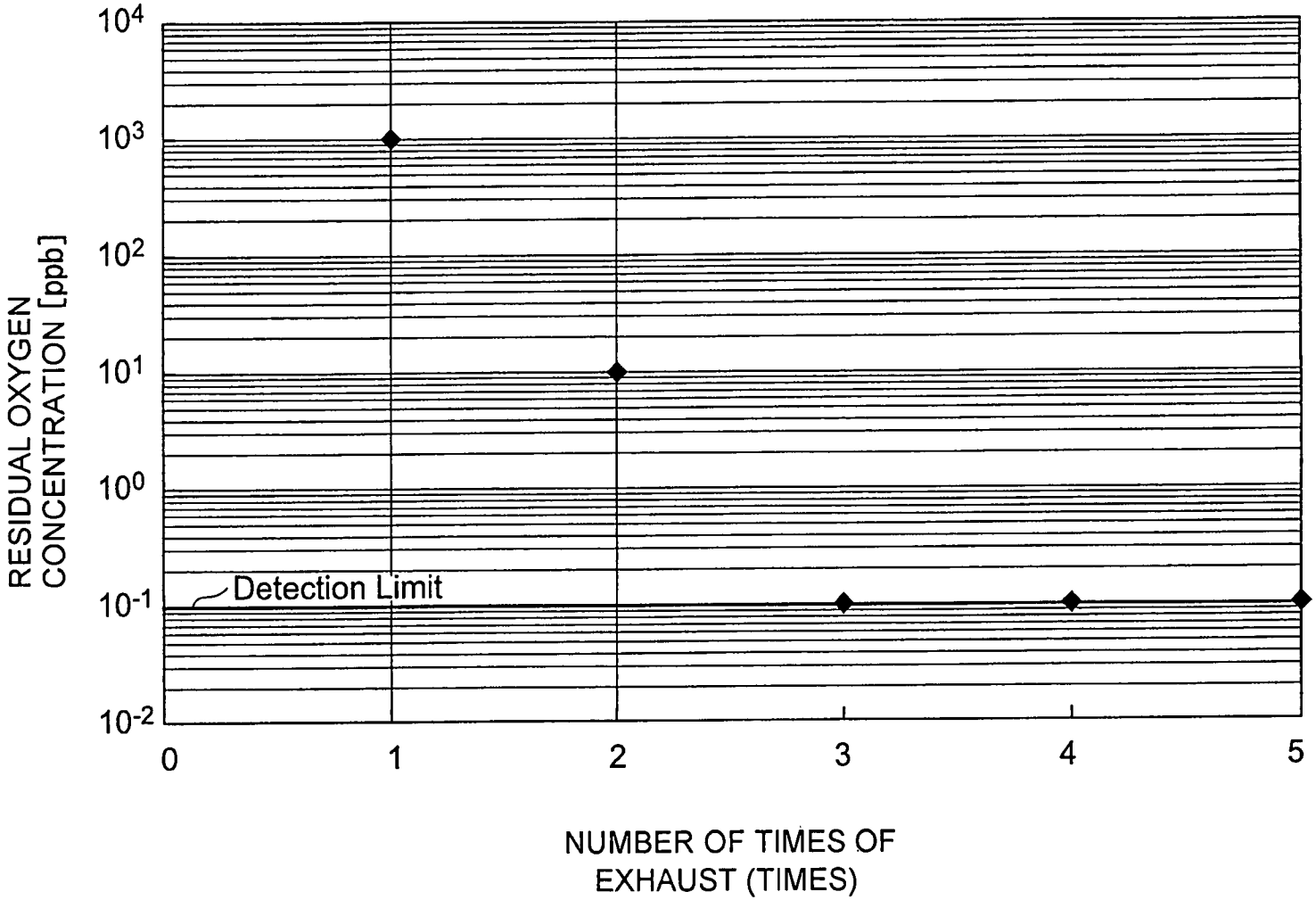
FIG. 12 is a graph showing a relationship between the number of exhaust times and the residual oxygen concentration in the structure shown in FIG. 11.

Description will be made of the exhaust method when exhausting the cold cathode lamp tube by the use of such an exhaust apparatus 212. In order to measure the effect of the exhaust method of this invention, stainless pipes 225 each having an inner diameter of 4 mm and a length of 70 cm were connected in place of the cold cathode lamp tubes 101 and the APIMS 224 was connected to an end opposite to the exhaust side as shown in FIG. 11. At first, a dry nitrogen gas was supplied to the second purge port in a flow rate of 100 cm$^3$/min. Then, the gate valve was opened to exhaust the inside of the pipes. Subsequently, the gate valve was closed and dry nitrogen was supplied to the first purge port 217 to achieve a normal pressure. Further, the first purge port 217 was closed and the gate valve 216 was opened to exhaust the inside of the tubes 101. This was repeated to complete the exhaust of the tubes 101. FIG. 12 shows a relationship between the number of exhaust times and the residual oxygen concentration. It has been found that the residual oxygen concentration can be reduced to 0.1 ppb, i.e. a detection limit or less, by setting the number of exhaust times to three or more. It has been found that evaporation of the electrode due to oxidation can be suppressed to improve the electrode life by reducing the residual oxygen concentration.

In the example shown in FIGS. 1 and 2, it is most effective when the shape of the open tip portion 106 or the bottom surface follows the hyperbolic function. However, it has been found that there is also an effect when rounding the edge portion of the tip portion or giving thereto an obtuse angle, thereby providing a curved shape other than the hyperbolic function. Further, in the foregoing embodiment, the description has been made of only such an electrode obtained, as the electron emitting electrode, by mixing W with $La_2O_3$. However, this invention is not limited thereto at all. W may be mixed with $ThO_2$ or $Y_2O_3$, a mixture thereof, or a mixture thereof with $La_2O_3$, or a material, other than W, having a high thermal conductivity may be mixed therewith.

As described above, according to this invention, the light emission efficiency can be improved by improving the electron emission efficiency and the long-life cold cathode fluorescent lamp can be obtained.

Further, in this invention, the increase in lifetime of the cold cathode fluorescent lamp can be realized even by improving the tube cleaning process. That is, in this invention, the increase in lifetime of the electrode itself is realized by forming the electron emitting electrode by the material containing tungsten excellent in thermal conductivity. Further, the effective electron emission area can be maximized by forming at least the open tip portion of the electron emitting electrode into the shape of the hyperbolic function or rounding the edge portion thereof to provide the curved shape and, therefore, the electron emission efficiency can be improved and thus the light emission efficiency can be improved.

On the other hand, in this invention, by using as the filler gas one or both of He and $H_2$ each having a high thermal conductivity, the heat radiation from the electrode can be efficiently carried out so that the increase in lifetime of the cold cathode fluorescent lamp can be achieved. Further, in this invention, the cleaning liquid is moved reciprocatingly, i.e. not only in the single direction, in the process of cleaning the inside of the fluorescent lamp tube so that the kinetic energy is efficiently given to the contaminant in the tube. Therefore, the cleaning efficiency is increased to suppress the uneven application of the phosphor, and so on, thereby achieving the improvement in luminance and the uniformization of luminance.

According to the method and apparatus for drying the inside of the cold cathode lamp tube of this invention, since the adsorbed moisture can be efficiently removed by the dry gas, the oxidation and evaporation of the tungsten component of the electrode due to the residual moisture is suppressed so that the electrode life can be improved.

Further, according to the method of exhausting the gas inside the cold cathode lamp tube of this invention, since oxygen remaining inside the tube can be efficiently exhausted, the oxidation and evaporation of the tungsten component of the electrode due to the residual oxygen is suppressed so that the electrode life can be improved.

INDUSTRIAL APPLICABILITY

As described above, a cathode for a fluorescent lamp according to this invention can be used not only as a cathode of a cold cathode fluorescent lamp for use as a backlight of a LCD, but also for other fluorescent lamps.

The invention claimed is:

1. A fluorescent lamp comprising an electron emitting electrode, wherein:

said electron emitting electrode has a portion that is formed by using a mixture of at least one material selected from the group consisting of $La_2O_3$, $ThO_2$, and $Y_2O_3$ and a metal having a thermal conductivity higher than that of said selected material; and wherein the electron emitting electrode has an open tip end substantially defined by a hyperbolic function.

2. The fluorescent lamp according to claim 1, wherein said material having higher thermal conductivity is tungsten (W).

3. The fluorescent lamp according to claim 2, wherein said electron emitting electrode is made of the same material as that of a lead wire which supplies a voltage to said electrode.

4. The fluorescent lamp according to claim 2, wherein at least one of $La_2O_3$, $ThO_2$, and $Y_2O_3$ is contained in a volume ratio of 0.001 to 0.5 relative to W.

5. The fluorescent lamp according to claim 2, wherein said at least one of $La_2O_3$, $ThO_2$, and $Y_2O_3$ is contained in a volume ratio of 0.01 to 0.1 relative to W.

6. The fluorescent lamp according to claim 1, wherein a portion, contacting a tube wall, of said electron emitting electrode does not contain said selected material.

7. The fluorescent lamp according to claim 1, comprising a tube is filled with a gas, wherein said gas contains at least one of He and $H_2$.

8. The fluorescent lamp according to claim 1, wherein said portion contains, by weight, 1 to 10% of said selected material.

9. The fluorescent lamp according to claim 8, wherein said portion contains, by weight, 5 to 7% of said selected material.

10. The fluorescent lamp according to claim 1, wherein the fluorescent lamp is a cold cathode fluorescent lamp.

11. A fluorescent lamp comprising an electron emitting electrode having a hollow cathode structure, wherein said electron emitting electrode has an open tip end of an obtuse angle shape or a curved shape, and wherein said open tip end of said electron emitting electrode has a shape substantially defined by a hyperbolic function.

12. The fluorescent lamp according to claim 11, wherein at least said open tip end of said electron emitting electrode is formed by using a mixture of at least one material selected from the group consisting of $La_2O_3$, $ThO_2$, and $Y_2O_3$ and W.

13. A fluorescent lamp electrode for use in a fluorescent lamp, formed by a mixture of at least one material selected from the group consisting of $La_2O_3$, $ThO_2$, and $Y_2O_3$ and W;

the fluorescent lamp electrode having an open tip end substantially defined by a hyperbolic function.

14. A method of manufacturing a fluorescent lamp comprises a step of cleaning in the state where the inside of a tube is filled with a cleaning liquid, wherein said step of cleaning performs the cleaning by reciprocating said cleaning liquid in the tube at a pressure higher than a normal pressure;

the method further comprising a step of mounting, within the tube, a fluorescent lamp electrode having an open tip end substantially defined by a hyperbolic function.

15. A method of manufacturing a fluorescent lamp including a step of drying by raising a temperature to desorb moisture inside a tube, characterized in that said step of drying is performed while feeding a dry gas through the inside of the tube;

the method further comprising a step of mounting, within the tube, a fluorescent lamp electrode having an open tip end substantially defined by a hyperbolic function.

16. The method of manufacturing a fluorescent lamp according to claim 15, wherein said dry gas is a nitrogen gas, a dry air, argon, or oxygen.

17. A method of manufacturing a fluorescent lamp including a step of exhausting a gas inside a tube, and a step of introducing an oxygen-free dry gas into said tube, wherein said steps are alternately repeated;

the method further comprising a step of mounting, within the tube, a fluorescent lamp electrode having an open tip end substantially defined by a hyperbolic function.

18. The method of manufacturing a fluorescent lamp according to claim 17, wherein said dry gas is a nitrogen gas or an argon gas.

19. The method of manufacturing a fluorescent lamp according to claim 17, wherein said fluorescent lamp is used as a cold cathode fluorescent lamp.

* * * * *